US005942731A

United States Patent [19]

Rogerson

[11] Patent Number: 5,942,731

[45] **Date of Patent: *Aug. 24, 1999**

[54] POLYMERIC COATED METALLIC MEMBERS FOR A UTILITY POLE

[76] Inventor: L. Keith Rogerson, No. 9 Fourth Ave., Isle of Palms, S.C. 29451

[ * ] Notice: This patent issued on a continued prosecution application filed under 37 CFR 1.53(d), and is subject to the twenty year patent term provisions of 35 U.S.C. 154(a)(2).

[21] Appl. No.: 08/390,115

[22] Filed: Feb. 17, 1995

[51] Int. Cl.[6] ..... H01B 17/16

[52] U.S. Cl. ..... 174/163 R; 174/158 R; 174/196; 411/383; 411/902

[58] Field of Search ..... 174/45 R, 163 R, 174/164, 158 F, 158 R, 196, 165, 200, 202, 204, 205; 411/383, 424, 902, 908

[56] References Cited

U.S. PATENT DOCUMENTS

| | | | |
|---|---|---|---|
| 600,607 | 3/1898 | Benedict | 174/163 R |
| 701,246 | 5/1902 | Baily | 174/163 R |
| 783,230 | 2/1905 | Steinberger | 174/165 |
| 805,167 | 11/1905 | Steinberger | 174/165 |
| 855,261 | 5/1907 | Steinberger | 174/165 |
| 1,202,418 | 10/1916 | Peirce, Jr. | 174/163 R |
| 2,082,507 | 6/1937 | Pittman | 174/158 R |
| 2,297,600 | 9/1942 | Williams | 174/205 |
| 2,947,802 | 8/1960 | Wortmann | 174/200 |
| 4,455,204 | 6/1984 | Pieslak et al. | 174/DIG. 8 X |
| 5,102,956 | 4/1992 | Holmes-Farley . | |
| 5,316,810 | 5/1994 | Rogerson . | |
| 5,358,682 | 10/1994 | Rogerson . | |
| 5,413,443 | 5/1995 | Aghamehdt | 174/165 X |

FOREIGN PATENT DOCUMENTS

| | | | |
|---|---|---|---|
| 233543 | 5/1961 | Australia | 174/200 |
| 237310 | 2/1962 | Australia | 174/200 |
| 558670 | 3/1957 | Italy | 174/165 |

OTHER PUBLICATIONS

BP Product Bulletin, Polybond 1000, 1001, 1002, 1003, Jun. 1989.

BP Technical Notes, Polybond, Grades Used as Additives in Filled Compounds, Sep. 1990.

BP Chemicals, Material Safety Data Sheet, Polybond 1001, Aug. 22, 1990.

BP Product Bulletin, Polybond 2021, Jan. 1990.

BP Product Bulletin, Polybond 1016, Aug. 1989.

BP Technical Notes, Polybond, Grades Used for Adhesion to Metals and Polar Polymers, Sep. 1990.

*Primary Examiner*—Hyung-Sub Sough

*Attorney, Agent, or Firm*—Dority & Manning, P.A.

[57] ABSTRACT

Improved metallic utility pole accessories used to either support objects on a utility pole or to support and stabilize the pole are provided. In general, the utility pole accessories include a polymeric chemically bonded coating that protects the underlying metal surface from corrosion. The coating also is substantially dielectric for preventing the accessories from interfering with the transmission of electricity through lines supported on the poles. The polymeric coating can be made from polymeric materials having functional monomers grafted thereto for chemically bonding with metal surfaces. Specific accessories within the scope of the present invention include crossbars, anchoring pins, transformer boxes, and guidewire supports. Also included is an improved insulator support post having a threaded portion made from a structural plastic material bonded to the polymeric coating.

4 Claims, 6 Drawing Sheets

POLYMERIC COATED METALLIC MEMBERS FOR A UTILITY POLE

BACKGROUND OF THE INVENTION

The present invention relates generally to polymeric coated support members and more particularly to support members coated with a reactive polymer for use on utility poles.

The purpose of a utility pole is to support various lines and to aide in their distribution. Some of the various lines that are supported on utility poles include telephone lines, television cables, and power or electric lines. Ideally, when supporting power lines, utility poles do not interfere with the transmission of electricity.

The top portion of a typical utility pole is represented in FIG. 1. As shown, a utility pole may include one or more crossbeams for supporting multiple lines and may further include various accessories for guiding lines and for supporting and anchoring the pole. For instance, some of these accessories may include ceramic insulators upon which the power lines rest. The ceramic insulators in turn are supported upon insulator posts that are attached to the utility pole or to a crossbeam.

Other accessories include crossbars, which can be used to support the crossbeams, and guidewires which help support the utility pole by extending from the pole to the ground. At the ground end, the guidewires are typically connected to a guidewire support which is in turn secured to a metal pin that has been driven into the ground.

Traditionally, utility poles including any crossbeams supported thereon have been made from pretreated wood. The above-described support members, including insulator posts, crossbars, and guidewires, on the other hand, have been made from metallic materials. Unfortunately, these metallic support members tend to corrode and fail over time, especially when placed in unfavorable environments. Further, being made from metal, some utility pole accessories have interfered with electrical transmissions through the lines that are supported on the pole.

For instance, in the past, insulator posts have been made from galvanized steel with a threaded portion made from lead. The lead portion is for attachment to a ceramic insulator which is placed in contact with a power line. The threaded portion must be made from a softer material in order to avoid cracking or harming the ceramic insulator during temperature swings. However, being made from a conductive metal, these insulator posts have been found to cause the supported power lines to arc-over. As used herein, an arc-over refers to an unwanted arc or discharge of electricity from a power line resulting from the breakdown of insulation. Arc-over causes a loss of electricity and a reduction in the efficiency of transmitting the electricity.

This phenomenon of arc-over of electrical lines caused by insulator posts is especially a problem for utility poles located in close proximity to large salt water bodies including oceans and salt water lakes. In particular, salt water found in the air in these regions enhances the ability for electricity to arc from the power line to the metallic posts.

Besides causing the loss of electricity in power lines, current insulator posts also pose a threat to the environment because they often contain large amounts of lead. Lead is a very toxic material that can pose some very serious health risks when present in water reserves or otherwise ingested. As such, it would be environmentally advantageous to replace the lead portion of insulator posts with a nontoxic material.

Besides causing the loss of electricity, metallic support members used on utility poles are also vulnerable to corrosion and ultimate failure. For example, the guidewires and crossbars as described above are known to rust and corrode over time. In particular, in some situations, the ends of guidewires are anchored to the ground submerged in a wet area or marsh. To prevent corrosion, plastic coatings have been applied to the wires. However, these coatings, thus far, have not proven successful in completely protecting the wires. In particular, the coatings tend to delaminate over time exposing the underlying metal.

Similar to guidewires, metallic crossbars have also been prone to corrode over time. Attempts to correct this problem have included making the crossbars out of corrosive resistant materials such as galvanized steel. However, crossbars located in wet environments still continue to corrode.

Besides guidewires and crossbars, all other metallic parts on utility poles have also been prone to failure and are subject to ultimate replacement. For instance, another major concern is the gradual corrosion of transformer boxes which are also found mounted to utility poles. As such, a need exists for replacing metallic support members used on utility poles with noncorrosive parts. Also, a need exists for utility pole accessories that do not interfere with the transmission of electricity through power lines supported on the poles. Ideally, the accessories are dielectric, meaning that the accessories can not conduct an electrical current.

SUMMARY OF THE INVENTION

The present invention recognizes and addresses the foregoing disadvantages, and others of prior art constructions.

Accordingly, it is an object of the present invention to provide improved structural members for use on utility poles.

It is another object of the present invention to provide metallic structural members for use on utility poles that have been coated with a reactive polymer.

It is another object of the present invention to provide structural members for use on utility poles that are dielectric.

Still another object of the present invention is to provide insulator posts for supporting ceramic insulators that are coated with a reactive polymer and which have a threaded portion made from a polymeric material.

It is still another object of the present invention to provide crossbars, guidewires, anchoring pins and transformer boxes for use on utility poles that having been coated with a reactive polymer in order to prevent corrosion.

It is another object of the present invention to provide a guidewire support for a utility pole that has been coated with a reactive polymer and which includes a bearing for engagement with a pin anchored to the ground.

These and other objects are achieved by providing improved utility pole accessories. The accessories are for supporting objects or power lines in association with a utility pole or for supporting and stabilizing the pole itself. In general, the accessories include an underlying metallic structural member having a polymeric coating covering at least a portion of the member. In a preferred embodiment, the polymer coating is chemically bonded to the metallic member for protecting the member from corrosion and oxidation. Further, the coating is substantially dielectric for preventing the loss of electricity through lines supported on the pole.

In one embodiment, the polymeric coating can be made from a polyolefin having functional monomers chemically attached thereto. For instance, the functional monomers can include acrylic acid, methacrylic acid, and maleic anhydrides.

One particular example of an accessory included within the scope of the present invention is a crossbar. The crossbar includes a metallic member in the shape of a rod having a first end and a second end. The first end is adapted to attach to a utility pole while the second end is adapted to attach to an object supported on the pole.

Another example is a guidewire support for receiving and engaging an end of a guidewire that is connected at an opposite end to a utility pole. The guidewire support includes a metallic coil having a first end section and a second section. The first end section and the second end section are adapted to be spirally wound together around the end of a guidewire for engagement therewith. When the end sections are wound together, the metallic coil forms a loop adapted to engage a corresponding pin affixed to a surface.

Also within the scope of the present invention is an improved transformer box and an improved anchoring pin. The transformer box includes a metal container adapted to contain a transformer. The polymeric coating as described above covers at least the outside surface of the metal container.

The anchoring pin includes an underlying metallic stem having a first end and a second end. In one embodiment, the first end has at least one thread integral therewith for burrowing the anchoring pin into the ground. The second end, on the other hand, is integral with a ring member adapted for connection with a guidewire that is attached at an opposite end to a utility pole. Again, at least a portion of the anchoring pin is coated with a polymeric material that is preferably chemically bonded to the metallic surface.

These and other objects are also achieved by providing an insulator post for supporting a ceramic insulator upon a utility pole. The insulator post includes a metallic stem having a first end adapted to engage a utility pole and a second end for supporting the ceramic insulator. The stem is covered with a polymeric coating that is chemically bonded to the metallic stem. The insulator post further includes a threaded portion positioned at the second end of the stem. The threaded portion is adapted to receive a ceramic insulator thereon. In particular, the threaded portion is made from a structural polymeric material that is bonded to the polymeric coating.

The structural polymeric material used to make the threaded portion can include a high density polyethylene. The polymeric coating, on the other hand, can include homopolymers and copolymers of polyolefins. More specifically, the polyolefin can have functional monomers chemically attached thereto. The functional monomers can include acrylic acid, methacrylic acid, and maleic anhydrides. In one embodiment, the threaded portion is injection molded onto the stem and onto at least a portion of the polymeric coating for bonding therewith.

Other objects, features and aspects of the present invention are discussed in greater detail below.

BRIEF DESCRIPTION OF THE DRAWINGS

A full and enabling disclosure of the present invention, including the best mode thereof to one skilled in the art, is set forth more particularly in the remainder of the specification including reference to the accompanying figures in which.

Figure 1:
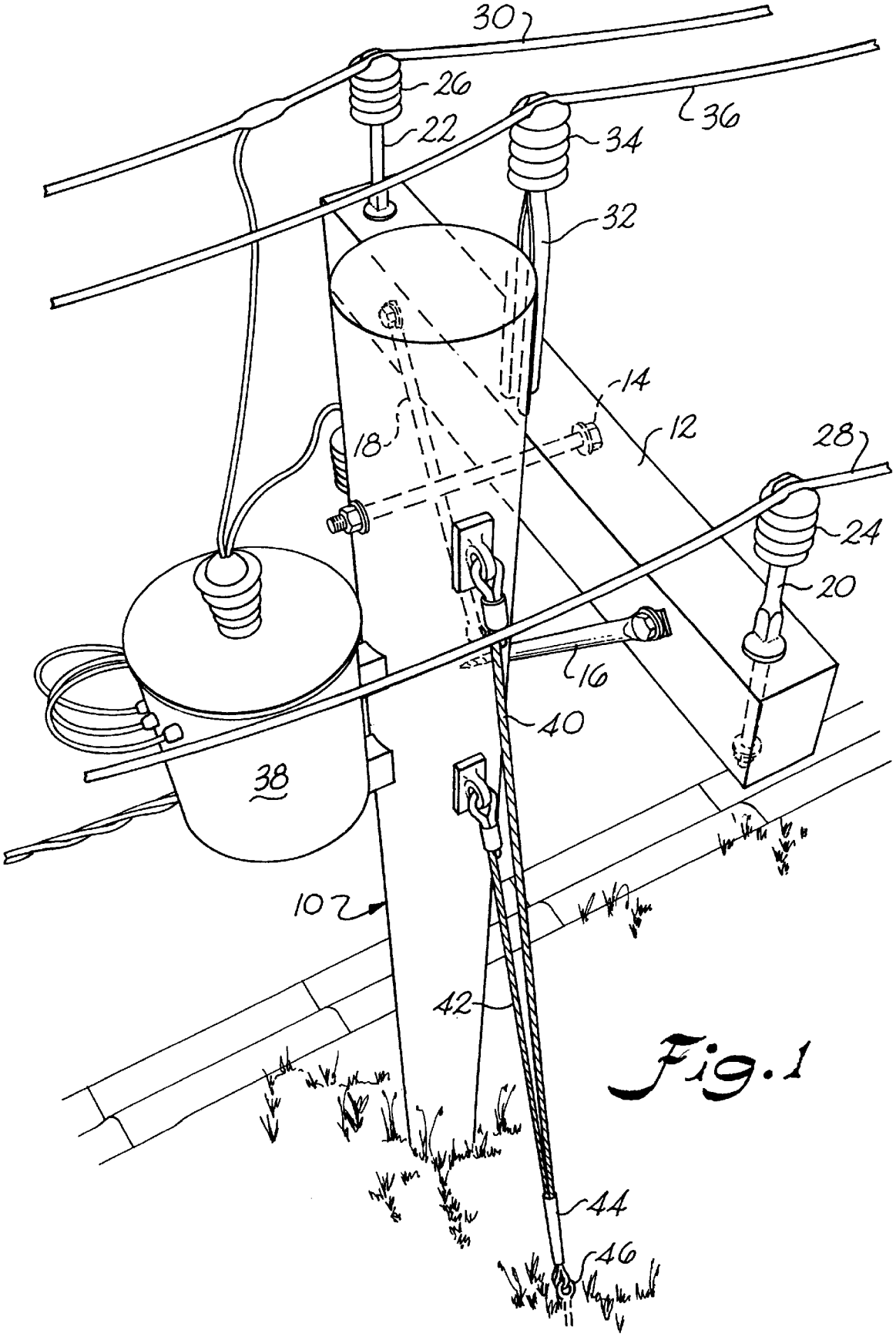
FIG. 1 is a perspective view of a utility pole illustrating various utility pole accessories made in accordance with the present invention.

Repeat use of reference characters in the present specification and drawings is intended to represent same or analogous features or elements of the invention.

DETAILED DESCRIPTION OF PREFERRED EMBODIMENTS

The present invention generally is directed to improved metallic utility pole accessories that are resistant to corrosion and that do not interfere with the transmission of electricity over lines supported on the poles. As used herein, the term "utility pole accessory" refers to any metallic member that is supported on, attached to, or in any way connected with utility poles. Inclusive within the term are insulator support posts, guidewires, guidewire supports, anchor pins, crossbars, and transformer boxes.

Specifically, the present invention is directed to telephone pole accessories that have been coated with a polymeric material. Preferably, the polymeric material chemically reacts with the underlying metal structure to form a chemical bond between the polymeric coating and the metallic surface. The resulting polymeric coating protects the structure from corrosion and oxidation and is substantially dielectric.

U.S. Pat. Nos. 5,358,682 and 5,316,810, both filed by the current inventor, which are incorporated herein in their entirety by reference thereto, discuss various polymeric materials that chemically react and bond to a metal surface. In particular, U.S. Pat. No. 5,358,682 is directed to a process for chemically bonding a polymeric lining to the interior surface of an enclosed structure, such as a hot water tank, while U.S. Pat. No. 5,316,810 is directed to polymeric structures secured to dissimilar components. The U.S. Pat. No. '810 discusses using polymers that chemically react to metallic surfaces as an adhesive layer between a metallic insert and a structure made from other types of polymeric materials.

The present invention is also directed to an improved insulator support post for use on utility poles. The improved insulator post is coated with a polymeric material and includes a threaded portion made from a structural plastic. Further, the insulator post made in accordance with the present invention does not contain a lead component like many prior art constructions.

Referring to FIG. 1, a typical utility pole generally 10 is shown illustrating the various accessories used to support power lines and to support and position the pole. Specifically, utility pole 10 includes a crossbeam 12 affixed to pole 10 by a bolt 14 and a pair of crossbars 16 and 18. Supported on crossbeam 12 are a pair of lateral insulator posts 20 and 22 having corresponding insulators 24 and 26, such as ceramic insulators, threaded thereto. Insulators 24 and 26 are for supporting and guiding a pair of power lines 28 and 30.

An alternative embodiment of an insulator post 32 is also included in FIG. 1 and is shown as being affixed directly to utility pole 10. Connected to insulator post 32 is a ceramic insulator 34 which supports a center power line 36.

Also supported upon pole 10 is a transformer box 38. Transformer box 38 contains a transformer for converting variations of current in a power line into variations of voltage and current into a secondary line. As shown, transformer box 38 is electrically connected to power line 30.

In order to support and position utility pole 10, a pair of guidewires 40 and 42 are connected to the pole and anchored in the ground. In particular, guidewires 40 and 42 are attached to a guidewire support 44 which in turn is connected to an anchoring pin 46.

As briefly described above, the present invention is directed to utility pole accessories coated with a polymeric material. Referring to FIG. 1, such accessories falling within the scope of the present invention include insulator support posts 20, 22 and 32, crossbars 16 and 18, transformer box 38, guidewires 40 and 42, guidewire support 44, and anchoring pin 46. Once these metallic structures are coated with a polymeric material in accordance with the present invention, they become more resistant to corrosion and decrease the amount of arc-over created in the power lines. The coated structures are particularly useful when exposed to or placed in potentially corrosive environments.

Various polymeric materials may be used in the present invention for coating the various metallic structures. The polymeric material can form a chemical bond with the surfaces of the accessories. The polymeric materials can be applied to the structure in a wet form or a dry form. In particular, the polymers can be applied to the surfaces of the structures using a fluidized bed, can be applied electrostatically, can be dip coated, or the structures can be powder coated. These various methods, including others, are well known in the art and are within the scope of the present invention.

Particular polymers found useful in the present invention include polyethylene and polypropylene. However, any other suitable polyolefin or plastic material can be used.

In a preferred embodiment, a polymer is chosen that will chemically bond to the surfaces of the metallic structure. Such polymers include polyolefins having functional monomers grafted thereto. Such polymeric materials can chemically bond to metal surfaces when heated. The polyolefins may include homopolymers or copolymers of polyethylenes, polypropylenes, ethylene vinyl acetate and the like. Functional monomers that can be grafted to these polyolefins include acrylic acid, methacrylic acid, maleic anhydrides and the like. Exemplary commercial polymeric materials suitable for use with the present invention include the POLYBOND products manufactured by BP Performance Polymers, Incorporated and the PLEXAR products manufactured by Quantum Chemical Corporation. These polymers chemically bond to most metal surfaces including steel, brass, aluminum, copper, zinc alloys and other alloys.

These particular polymers, by chemically bonding to surfaces of the metallic structure, have demonstrated to be more durable during use and more corrosive resistant than other polymeric materials.

When using these chemically reactive polymers, preferably the surface of the underlying metallic structure is first washed and cleaned before being coated in order to remove any dirt or oily materials. It is also preferred, that prior to bonding, a neutral pH be maintained on the surface to be coated. Preparation of the metallic structure can be performed by washing them in a dilute acid, such as an aqueous solution containing hydrochloric acid or sulfuric acid. After washing, the surfaces should be dried before the chemical reactive polymers are applied.

Many of the chemically reactive polymers described above melt at a lower temperature than which they chemically react to metallic surfaces. For instance, some of the reactive polymers described above have a melting point between about 250° F. and about 350° F. These polymers, on the other hand, chemically bond to metallic surfaces at temperatures between about 400° F. and about 600° F. As such, when applying these polymers in accordance with the present invention, it is important that the temperature and pressure be sufficient for the polymer to chemically bond to the metal. Once this initial chemical bond is formed and the surface of the metallic structure is covered, then additional polymer can be added at the melting point.

In one embodiment, the metallic structures can be first coated with the above described chemically reactive polymers. Additional coats of other polymers that do not chemically bond to metals can then be applied to the structures for increasing the overall thickness of the coating. These additional coatings can be made from various types of polymers such as homopolymers and copolymers of polyolefins. These polymers can be selected for economic reasons or for providing a particular amount of protection. In this embodiment, the chemically reactive polymers act as an adhesive between the underlying metal substrate and the outer coatings.

Particular examples of utility pole accessories made in accordance with the present invention will now be described with reference to the remaining figures.

Figure 2:
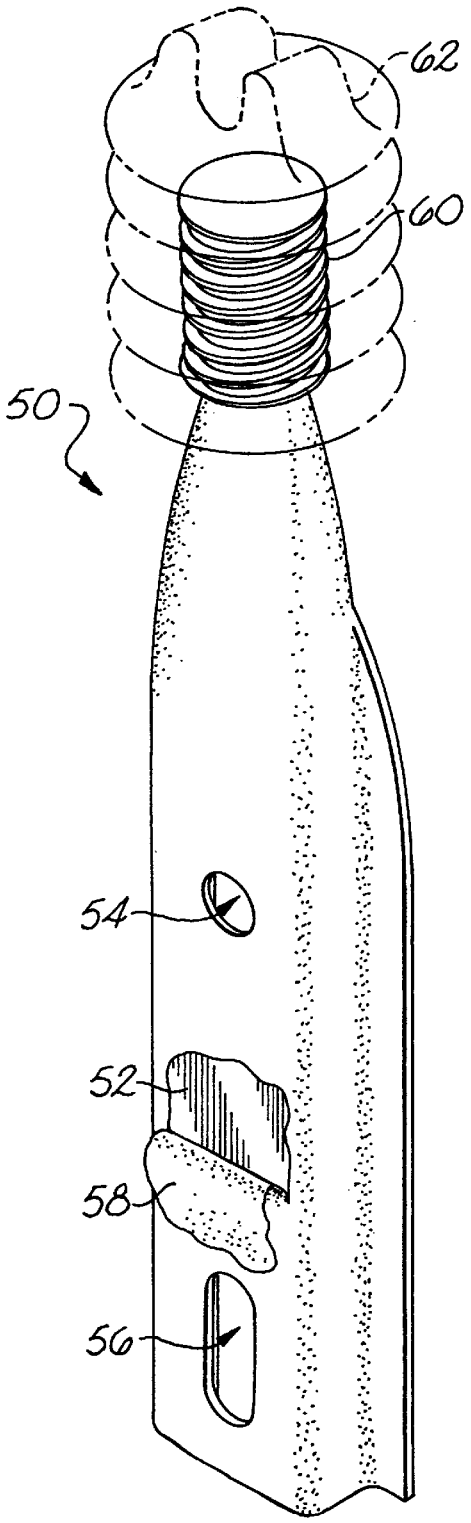
FIG. 2 is a perspective view of one embodiment of an insulator post made in accordance with the present invention.
Figure 3:
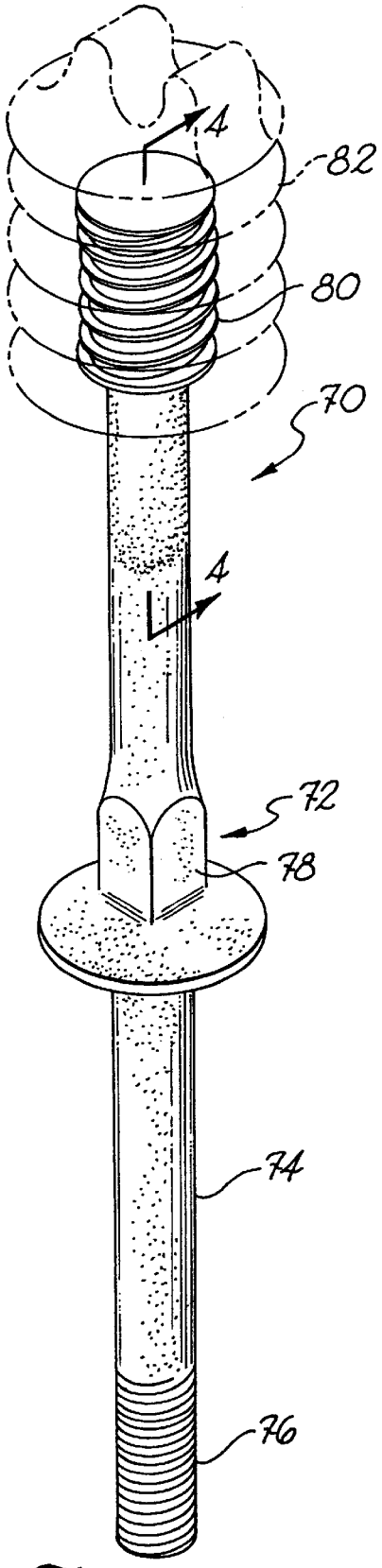
FIG. 3 is a perspective view of another embodiment of an insulator post made in accordance with the present invention.

Referring to FIGS. 2 and 3, two embodiments of an insulator support post made in accordance with the present invention are illustrated. In particular, an insulator post generally 50 is shown in FIG. 2. Insulator post 50 includes a metallic stem 52 defining a pair of openings 54 and 56. Openings 54 and 56 are for bolting or otherwise securing the insulator post to a utility pole. In accordance with the present invention, stem 52 is coated with a polymeric material 58. As stated above, preferably polymeric coating 58 is chemically bonded to the metallic surface, which, in essence, makes the coating to surface interface stronger than the polymeric material itself. Once chemically bonded to the metallic stem, the polymeric coating will not delaminate.

At the top end of insulator post 50 is a threaded portion 60 adapted to receive a ceramic insulator 62 as shown in phantom. In the past, threaded portion 60 was made from a soft metal, such as lead, so that it would not harm or damage the ceramic insulator during temperature swings when metals tend to expand and contract. However, instead of being made from lead, threaded portion 60 of insulator post 50 of the present invention is made from a structural plastic material. As used herein, a structural plastic material is defined as a plastic or polymeric material with enough hardness and rigidity to support a ceramic insulator. Preferably, threaded portion 60 is made from high density polyethylene. However, other polyolefins may work equally as well.

Most structural plastic materials will not readily bond, either mechanically or chemically, to metal surfaces. However, structural plastics will blend and bond with other polymeric materials such as polymeric coating 58. As such, in constructing insulator post 50, metallic stem 52 is preferably first coated with polymeric material 58. Next, threaded portion 60 can be added to the coated stem. In particular, threaded portion 60 can be injection molded onto the stem. Upon being placed on the stem, threaded portion 60 will bond to polymeric coating 58 and, thus, secure the threaded portion to insulator post 50.

Referring to FIG. 3, an alternative embodiment of an insulator post generally 70 is shown. Insulator post 70 includes a metallic stem 72 having a bottom portion 74. In this embodiment, insulator post 70 is for placement upon a crossbeam for subsequently supporting a power line. Specifically, bottom portion 74 is for insertion into an opening in a crossbeam as shown in FIG. 1. Thread 76 of bottom portion 74 is for receiving appropriate securing means such as a nut for affixing the insulator post to a crossbeam.

Metallic stem 72, similar to FIG. 2, is coated with a polymeric material 78 which is preferably chemically bonded to the metallic surface. Polymeric material 78 can be used to coat the entire stem 72 or just a portion of the stem. When insulator support post 70 is used to support a live wire, as opposed to a ground wire, preferably thread portion 76 is not coated with a polymer in order to ground the stem to the utility pole. Instead of being coated with a polymer, thread portion 76 can be galvanized. If not grounded to the utility pole, the insulator support post may cause radio interference.

Mounted on the top of stem 72 and bonded to coating 78 is a threaded portion 80 made from a structural plastic. Threaded portion 80 is for receiving a ceramic insulator 82 shown in phantom.

Figure 4:
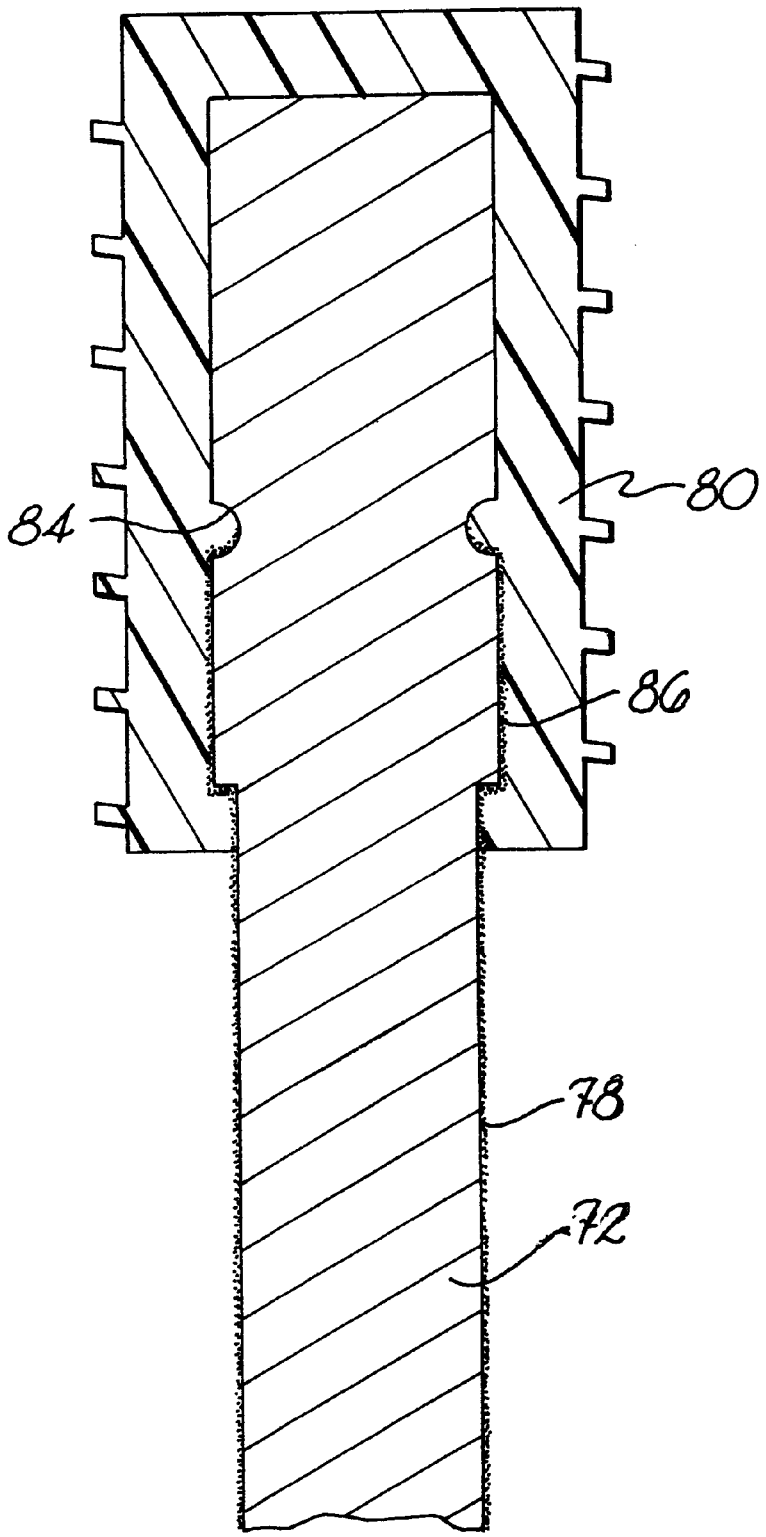
FIG. 4 is a side view taken along line 4—4 of FIG. 3.

Referring to FIG. 4, a cross sectional view of the top of insulator post 70 is illustrated for the purpose of explaining in more detail one embodiment for constructing and manufacturing the insulator posts of the present invention. As shown, metallic stem 72 includes an indentation ring 84. Ring 84 is provided for allowing a mechanical device to hold the stem during processing. Once secured to a device, stem 72 can be first heated to a temperature sufficient for chemically bonding a polymer to the metal surface. After heating, stem 72 can then be coated with a polymeric material by dip coating or by any other similar procedure.

Once coated with a polymeric material and after the coating has cooled, the stem can be removed from the mechanical device. Next, a structural plastic can be injection molded on the end of the stem for forming threaded portion 80. Threaded portion 80 bonds to a portion of the polymeric coating 86 for securing the threaded portion to the metal stem. The resulting insulator post is corrosion resistant and substantially dielectric. The post, when combined with a ceramic insulator, can be mounted to a utility pole for supporting a power line without interfering with the transmission of electricity.

Figure 5:
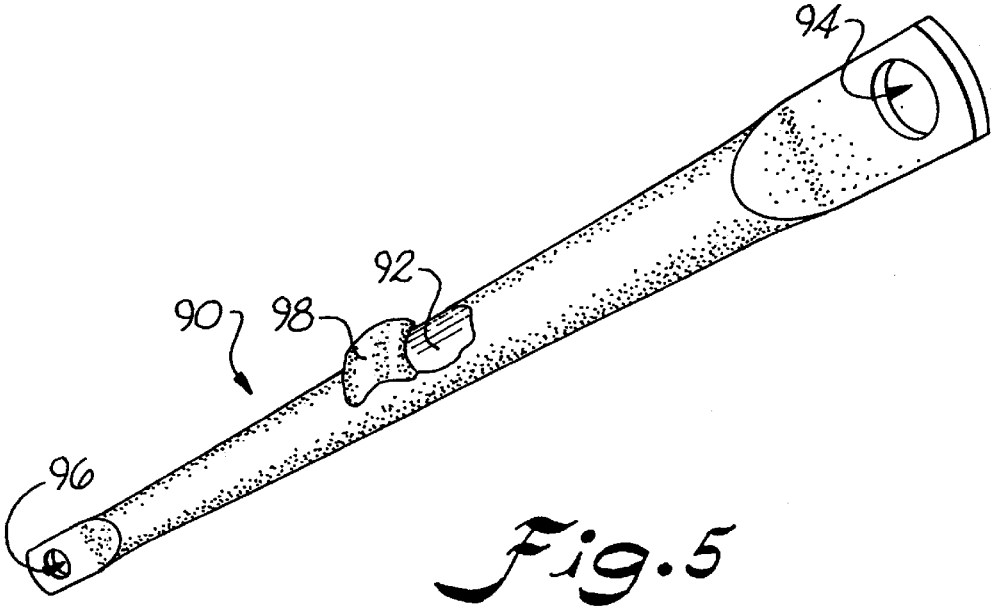
FIG. 5 is a perspective view of a crossbar made in accordance with the present invention and for use on a utility pole.

Besides insulator posts, the present invention is also directed to other improved accessories for use with utility poles. For instance, referring to FIG. 5, a crossbar generally 90 is illustrated made in accordance with the present invention. Crossbar 90 includes a metallic rod 92 defining a first aperture 94 and a second aperture 96. Apertures 94 and 96 are for attachment to a utility pole or to an object or structure being supported upon the pole.

In accordance with the present invention, crossbar 90 includes a polymeric coating 98 which is preferably chemically bonded to the metallic surface. By including a coating of reactive polymers on crossbar 90, the crossbar becomes much more resistant to rust or corrosion and becomes substantially dielectric.

Figure 11:
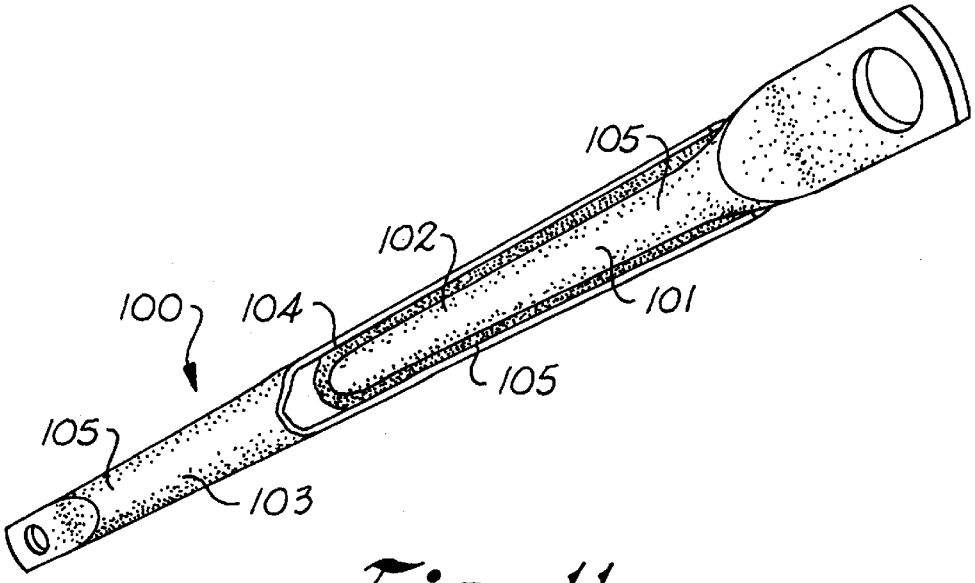
FIG. 11 is a perspective view of an alternative embodiment of a crossbar made in accordance with the present invention.

An alternative embodiment of a crossbar generally 100 is illustrated in FIG. 11. Crossbar 100 includes a first metallic member 101 having a pin section 102. Pin section 102 is inserted into a second metallic member 103 having a corresponding hollow cylindrical section 104. First metallic member 101, second metallic member 103, and the interior surface of cylindrical section 104 are coated with a polymeric material 105.

In constructing crossbar 100, metallic members 101 and 103 are first coated with polymeric material 105. More polymeric material 105 is then loaded into cylindrical section 104. While the polymeric material is in a molten state inside cylindrical section 104, pin section 102 is inserted therein. After cooling, polymeric material 105 bonds first metallic member 101 to second metallic member 103.

Crossbar 100 is constructed as described above in order to eliminate the possibility of an electrical current flowing from one end of the crossbar to the other. For instance, if the crossbar were constructed of a single unitary piece and a portion of the coating was chipped off, an electrical current may be able to be conducted through the exposed part of the metal. In this embodiment, if a portion of the polymeric coating were chipped away, an electrical current would be prevented from flowing from one end of the crossbar to an opposite end.

Figure 6:
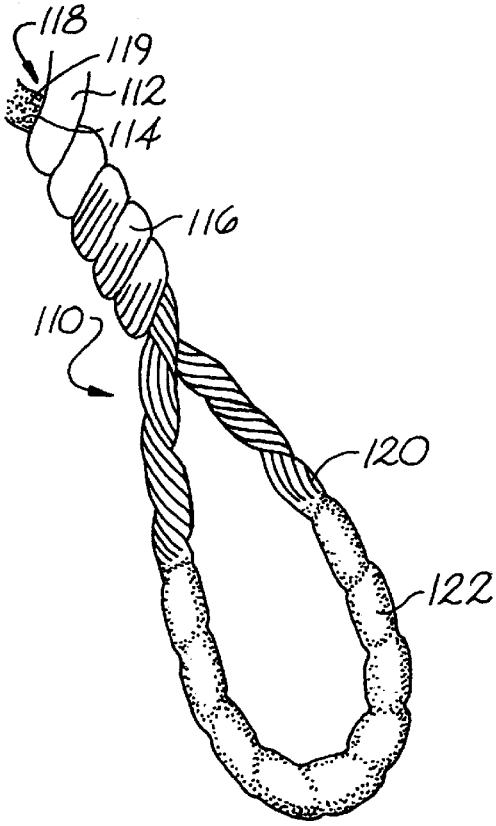
FIG. 6 is a perspective view of a guidewire support made in accordance with the present invention.

Referring to FIG. 6, a guidewire support generally 110 is illustrated. Guidewire support 110 is for receiving, engaging and encasing the end of a guidewire at one end and for connection to an anchoring pin at an opposite end. Guidewire support 110 includes a first section 112 and a second section 114. Sections 112 and 114 are typically made from a ribbon of parallel wires. When ribbon 112 is spirally wound with ribbon 114, a metallic coil 116 forms defining a circular passage 118. During use, ribbon 112 and ribbon 114 are spirally wound together around the end of a guidewire. A grit-like substance 119 such as sand is adhesively secured to the inside surface of ribbons 112 and 114. When ribbons 112 and 114 are wrapped around a guidewire, grit-like substance 119 grips and engages the guidewire for securing it to the guidewire support.

Guidewire support 110 also includes a loop section 120 located in between sections 112 and 114. Before sections 112 and 114 are wrapped around the end of a guidewire, loop section 120 is typically placed through a ring located on an anchoring pin for anchoring a guidewire to the ground. In wet areas such as marsh lands, loop section 120, which is constantly under tension, is prone to corrosion and ultimate failure. Consequently, in accordance with the present invention, guidewire support 110 as shown in FIG. 6 includes a polymeric coating 122 which is preferably chemically bonded to the metal surfaces of loop 120.

As shown in FIG. 6, coating 122 only partially covers loop section 120. However, depending upon the circumstances and the amount of protection needed, coating 122 can be increased to cover the entire loop section and ribbons 112 and 114. Polymeric coating 122 can also be used to adhesively secure grit-like substance 119 to the inside surface of the ribbons. Further, if desired, the guidewire extending into the guidewire support can be similarly coated.

Figure 7:
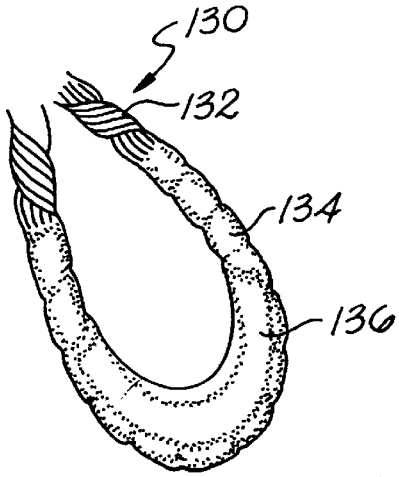
FIG. 7 is an alternative embodiment of a guidewire support made in accordance with the present invention.

Referring to FIG. 7, an alternative embodiment of a guidewire support generally 130 is shown. Similar to FIG. 6, guidewire support 130 includes a loop section 132 coated with a reactive polymer 134. In this embodiment, in order to further strengthen loop section 132, a saddle bearing 136 made from a structural plastic is attached to the loop where the loop is adapted to engage an anchor pin. Similar to the insulator post described above, saddle bearing 136 can be injection molded onto the loop and bonded to polymeric coating 134. If desired, a further coating of polymeric material can be placed over the saddle bearing after the bearing has been attached to the polymeric coating.

Polymeric coating 134, as shown in FIG. 7, only covers a portion of loop 132. However, similar to FIG. 6, coating 134 can be extended to cover the entire guidewire support if desired.

Figure 8:
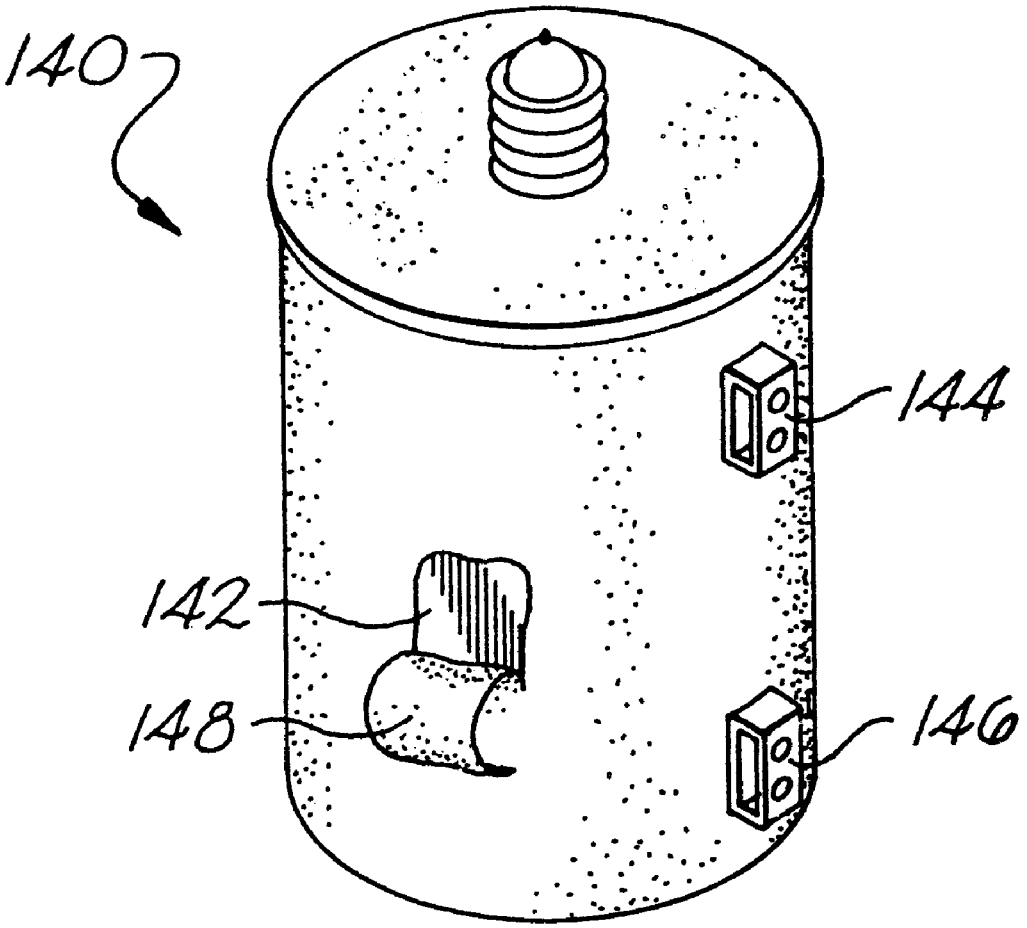
FIG. 8 is a perspective view of a transformer box made in accordance with the present invention.

Another utility pole accessory made in accordance with the present invention is illustrated in FIG. 8. Referring to FIG. 8, a transformer box generally 140 is shown for containing a transformer and for mounting the transformer to a utility pole or otherwise. Transformer box 140 includes a metallic container 142. Mounted to container 142 are a pair of brackets 144 and 146 for attaching the transformer box to an adjacent structure. In accordance with the present invention, container 142 further includes a polymeric coating 148 preferably made from a reactive polymer that chemically bonds to the metal surface. As explained above, the coating protects the metal container from rust and corrosion. Further the coating is nonconductive making the transformer box substantially dielectric.

Figure 9:
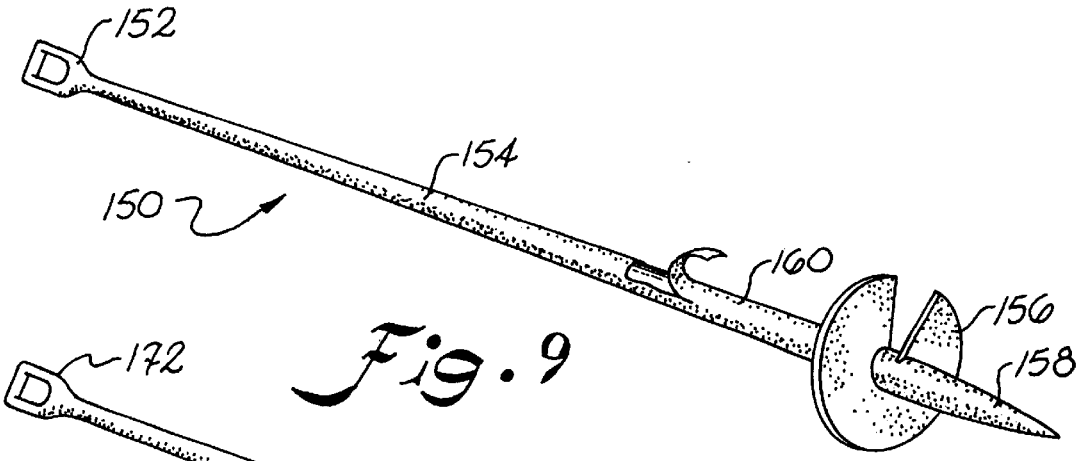
FIG. 9 is a perspective view of an anchor pin made in accordance with the present invention.

Another example of a device used in connection with utility poles that can be coated with polymeric materials in accordance with the present invention is an anchoring pin generally 150 as shown in FIG. 9. Pin 150 includes a ring 152 adapted to engage a guidewire support for supporting a guidewire and stabilizing a utility pole. Connected to ring 152 is a metallic stem 154 ending in a spike 158. Above spike 158 is a thread 156 used for drilling and securing anchoring pin 150 into the ground. As shown in FIG. 1, when pin 150 is placed in the ground, only ring 152 and a portion of stem 154 remain visible.

Referring back to FIG. 9, anchoring pin 150 can include a polymeric coating 160 that is preferably chemically reacted with the metallic surface. As shown in FIG. 9, coating 160 covers ring 152 and a portion of stem 154. However, the extent that pin 150 is coated with the polymeric material will depend upon the circumstances and the particular application. For instance, the coating can be used to only cover a portion of ring 152 or can be used to coat the entire anchoring pin. Regardless, the coated portion of the anchoring pin will be protected from the elements and will be resistant to corrosion.

Figure 10:
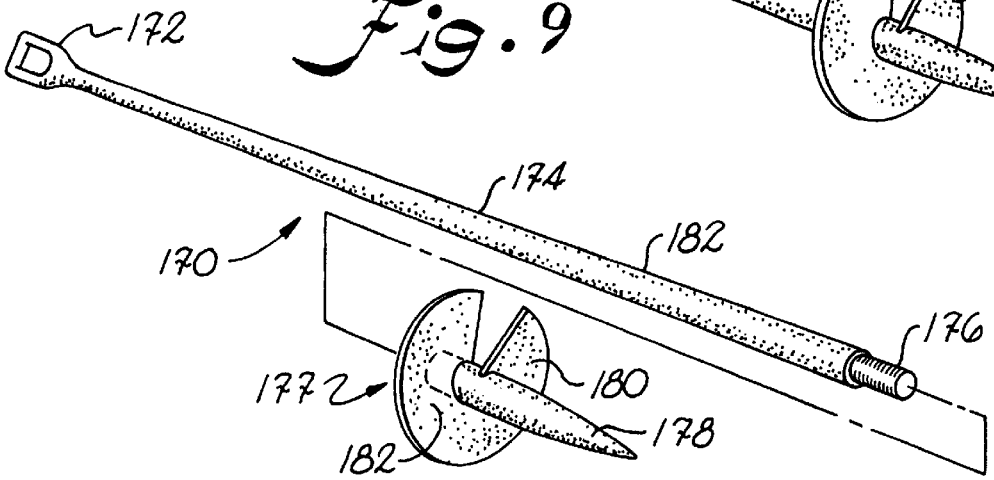
FIG. 10 is a perspective view of another embodiment of an anchor pin made in accordance with the present invention.

An alternative embodiment of an anchoring pin generally 170 is illustrated in FIG. 10. Similar to the embodiment shown in FIG. 9, anchoring pin 170 includes a ring 172 integral with a metallic stem 174. In this embodiment, however, stem 174 ends with a threaded portion 176.

Anchoring pin 170 further includes an end portion 177 having a spike 178 and a thread 180. End portion 177 is adapted to be secured to threaded portion 176 of stem 174. In this embodiment, end portion 177 is typically first driven into the ground by a drilling apparatus. Once end portion 177 is secured in the ground, then stem 174 is attached thereto.

As shown, anchoring pin 170 can include a polymeric coating 182 that is preferably chemically reactive with the metallic surface. The coating covers and protects the underlying metal.

In summary, the present invention, as shown in the Figures, is generally directed to coating metallic structural members, which are used on or near utility poles, with a reactive polymer that chemically bonds to metallic surfaces. Specifically, improved insulator posts, crossbars, guidewire supports, guidewires, transformer boxes, and anchoring pins were discussed and described above. However, the reactive polymer can be used to coat any metallic utility pole accessory that may be susceptible to corrosion or may cause the loss of electricity through power lines in close proximity thereto.

These and other modifications and variations of the present invention may be practiced by those of ordinary skill in the art, without departing from the spirit and scope of the present invention, which is more particularly set forth in the appended claims. In addition, those of ordinary skill in the art will recognize that features and aspects of the various embodiments of the present invention are interchangeable both in whole or in part. Furthermore, those of ordinary skill in the art will appreciate that the foregoing description is by way of example only, and is not intended to limit the invention as defined in the following claims.

I claim:

1. An insulator post for supporting an insulator upon a utility pole, said insulator post comprising:

a metallic stem having a first end, a middle portion, and a second end, said first end of said stem being adapted to engage the utility pole;

a polymeric coating covering at least said middle portion and said second end of said metallic stem, said polymeric coating being chemically bonded to said metallic stem, said polymeric coating comprising a polyolefin having functional monomers chemically attached thereto; and an insulator receiving portion covering said second end of said stem, said insulator receiving portion being adapted to be connected with an insulator, said insulator receiving portion being made from a rigid polyolefin, said insulator receiving portion including threads for engaging an insulator, said threads being made solely from said rigid polyolefin, said insulator receiving portion being blended with and bonded to said polymeric coating.

2. An insulator post as defined in claim 1, wherein said insulator receiving portion is made from high density polyethylene.

3. An insulator post as defined in claim 1, wherein said functional monomers comprise a material selected from the group consisting of acrylic acid, methacrylic acid and maleic anhydride.

4. An insulator post as defined in claim 1, wherein said metallic stem includes an uncoated exposed section for electrically grounding said stem.

* * * * *